US005983808A

United States Patent [19]

Weil

[11] Patent Number: 5,983,808

[45] Date of Patent: Nov. 16, 1999

[54] SHELVING SYSTEM FOR CONCEALING AN APPLIANCE

[76] Inventor: Louis Weil, 644 N. Spence Ave., Goldsboro, N.C. 27534

[21] Appl. No.: 09/020,354

[22] Filed: Feb. 9, 1998

[51] Int. Cl.[6] ..... A47B 23/00

[52] U.S. Cl. ..... 108/452; 108/90; 211/90.01

[58] Field of Search ..... 108/42, 90, 92, 108/93, 115, 67, 47, 48, 108, 50.011; 312/279, 228.1, 235.1, 201; 211/1.3, 90.01, 90.02, 90.04, 99

[56] References Cited

U.S. PATENT DOCUMENTS

| | | | |
|---|---|---|---|
| 2,527,056 | 10/1950 | Cain | 108/93 X |
| 3,364,637 | 1/1968 | Curra, Jr. | 108/93 X |
| 3,948,191 | 4/1976 | Hatherley | 211/90.01 X |
| 4,159,071 | 6/1979 | Roca | 108/42 X |
| 4,750,402 | 6/1988 | Markey | 108/90 X |
| 5,094,515 | 3/1992 | Low | 312/235.1 |
| 5,107,957 | 4/1992 | Bennet | 312/235.1 X |
| 5,170,719 | 12/1992 | Pestone | 108/48 |

*Primary Examiner*—Jose V. Chen
*Attorney, Agent, or Firm*—Coats & Bennett, P.L.L.C.

[57] ABSTRACT

A folding countertop system is used to conceal an appliance and to provide a countertop which functions as a service area or additional usable counter space. The countertop system includes a top shelf which is disposed above the appliance, a drop panel which extends downwardly from the top shelf to an upper surface of the appliance, and a countertop which extends forwardly from the drop panel and rests on the upper surface of the appliance. The top shelf, drop panel and countertop can be folded and stacked when it is desired to use the appliance. The countertop system may also include a skirt which extends downwardly from a forward edge of the countertop to cover the front of the appliance.

16 Claims, 3 Drawing Sheets

SHELVING SYSTEM FOR CONCEALING AN APPLIANCE

FIELD OF THE INVENTION

The present invention relates generally to shelving systems and, more particularly, to a collapsible shelving system for concealing an appliance.

BACKGROUND OF THE INVENTION

Many homes have a designated room or laundry area where a washing machine and dryer are located. Owners of such homes are thus provided with a convenient place for doing laundry which is out-of-site of visitors. However, not all homes have a sufficient space for laundry rooms or designated wash areas. In smaller homes, the washing machine and dryer are sometimes located in one of the living areas of the home. For example, it is quite common to find the washing machine and dryer located in the kitchen of a home.

When appliances, such as a washing machine and dryer, are located in a living area of the home, it is common to conceal the appliance behind folding doors. In some homes, the use of folding doors to conceal the appliance are not practical, or are too expensive. Thus, some persons have no alternative but to leave the appliances exposed to full view.

Another problem associated with the use of appliances in smaller homes is that the appliances take up a relatively large amount of space which might otherwise be used for other purposes. For example, the location of the appliances in the kitchen of a small home reduces the amount of space available for cabinets and counters. Thus, homeowners are often forced to choose between having the appliance, or having additional cabinets and counters.

SUMMARY AND OBJECTS OF THE INVENTION

The present invention is a folding countertop system for concealing an appliance. The countertop system of the present invention is particularly designed for use with a conventional washing machine and dryer. The countertop system forms a shelf above the console of the appliance and a countertop that rests on an upper surface of the appliance. In the preferred embodiment of the invention, the forward edge of the countertop extends beyond the forward edge of the appliance. A fabric skirt is attached to the front edge of the countertop and extends to the floor to completely conceal the appliance from view. The countertop can be used as a work surface or service area. For example, the countertop could be used as a service area for food or beverages while entertaining guests in the home or as an additional countertop working area.

When the countertop system is not in use, the components of the system can be folded and stacked to allow use of the appliance. When the homeowner is finished using the appliance, the countertop system can be unstacked and unfolded to recover the appliance. The system is designed to allow quick and easy assembly and disassembly of the countertop system.

The countertop system of the present invention provides a relatively simple and cost effective method for concealing an appliance which is located in the living area of the home. Further, the countertop system also allows the effective use of space for multiple purposes. That is, the countertop system allows space allocated for a washer and dryer to also be used for other functions.

Other objects and advantages of the present invention will become apparent and obvious from a study of the following description and the accompanying drawings which are merely illustrative of such invention.

DETAILED DESCRIPTION OF THE INVENTION

Figure 1:
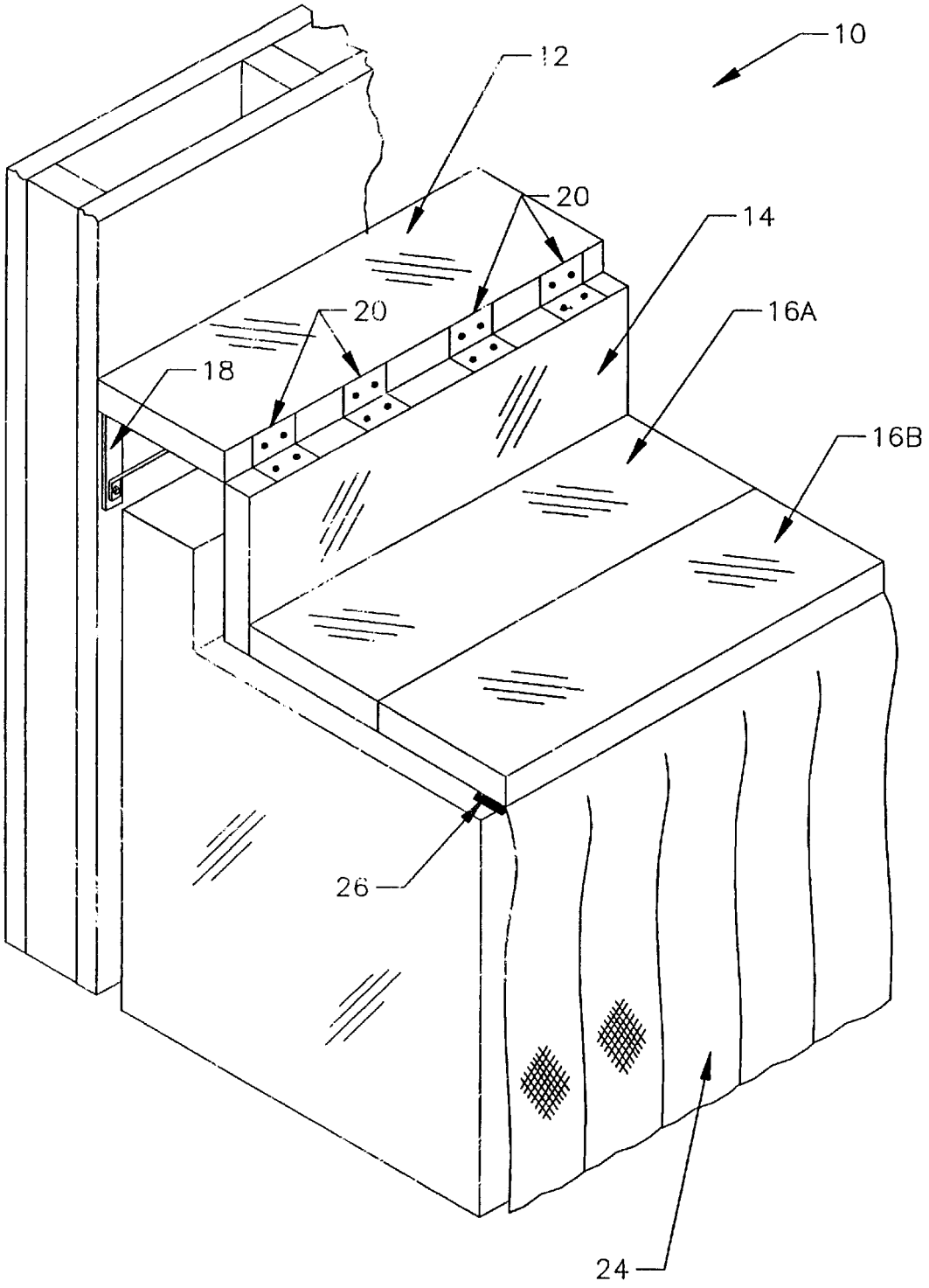
FIG. 1 is a perspective view of the countertop system of the present invention.

Referring now to the drawings, the folding countertop system of the present invention is shown therein and indicated generally by the numeral 10. The countertop system 10 is used to provide a temporary cover for one or more appliances which also functions as a countertop. Thus, the countertop system 10 can be used as a work area or a service area.

In the disclosed embodiment, the countertop system 10 is used to cover a conventional washing machine and dryer. Both the washing machine and dryer include a cabinet having a console extending from an upper surface thereof. The control for the appliances are disposed on the console. The countertop system 10 of the present invention is designed to provide a shelf above the console of the appliance as well as a countertop on the upper surface of the appliance.

The countertop system 10 of the present invention comprises a top shelf 12 disposed above the console of the appliance, a drop panel 14 that extends downwardly from the top shelf 12, and a countertop 16 that rests on the upper surface of the appliance. The top shelf 12, drop panel 14, and countertop 16 can be made from solid wood, a laminated wood product, or particle board. If a laminated wood product is used, tape may be applied to the edges of the boards to cover the laminates. Alternately, the laminates can be left exposed as a design element. If particle board is used, it may be desirable to apply a covering to the boards. The covering can be made of a textile material, or synthetic material such as vinyl.

The top shelf 12 is supported in spaced relation above the console of the appliance. Two or more L-shaped brackets 18 are fixed to a wall disposed immediately behind the appliance. The wall brackets 18 are preferably fixed by screws to the wall. Adjustable wall brackets 18 may also be used which allow the height of the top shelf 12 relative to the appliance to be adjusted.

In the preferred embodiment of the invention, the top shelf 12 rests on top of the L-shaped brackets 18 but is not fixed to the brackets 18. However, if it is desired, the top shelf 12 may be fixed to the bracket.

The drop panel 14 extends downwardly from a forward edge of the top shelf 12 to the upper surface of the appliance. The drop panel 14 is connected to the top shelf 12 by a plurality of hinges 20. The hinges 20 allow the drop panel 14 to be folded against the underside of the top shelf 12 in a storage configuration. In order to fold the drop panel 14 against the top shelf 12, it is necessary to lift the top shelf 12 off the L-shaped brackets 18. The drop panel 14 can then be folded underneath the top shelf 12 which is then placed back on the L-shaped brackets 18.

Figure 2:
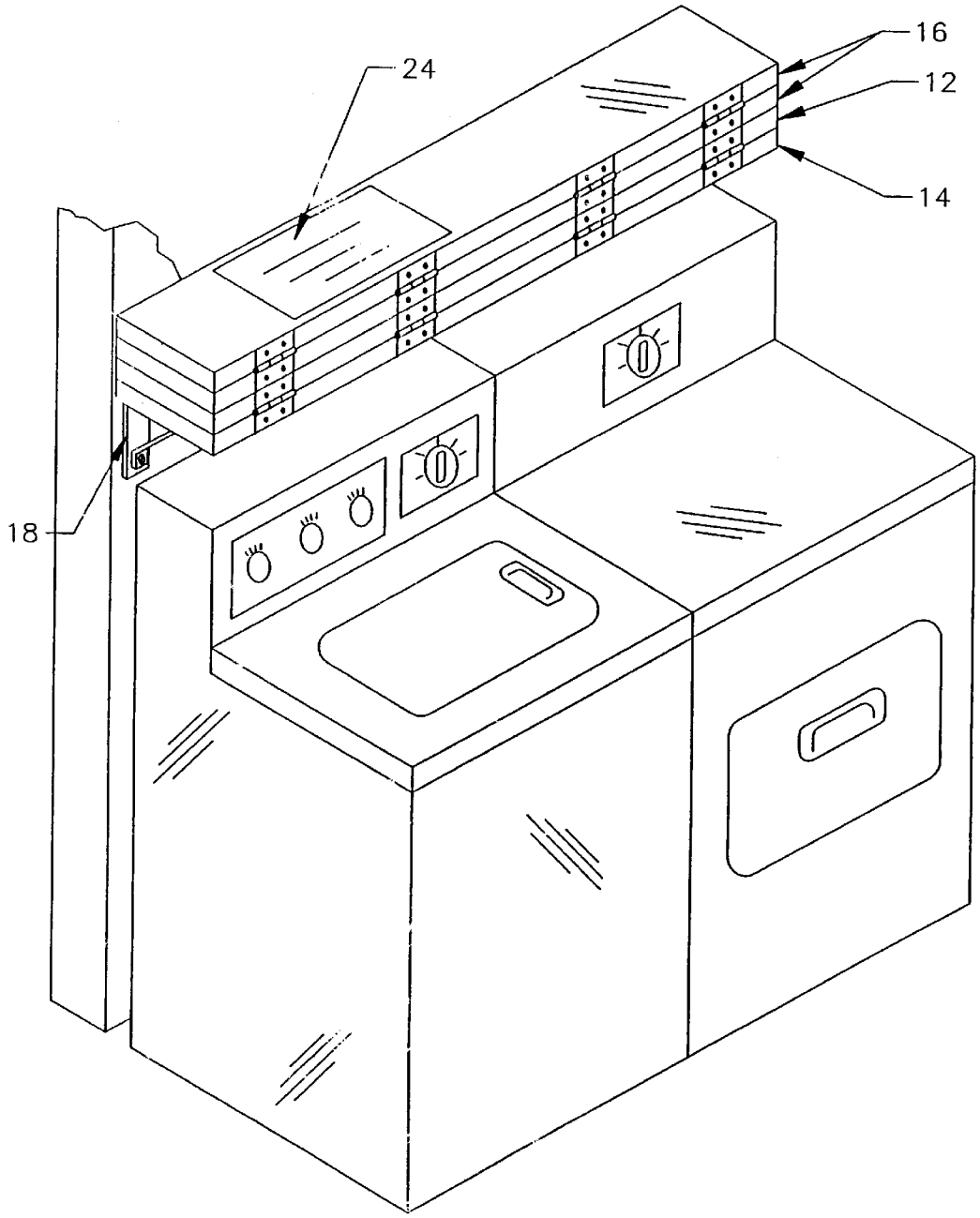
FIG. 2 is a perspective view of the countertop system shown in a storage configuration.
Figure 3:
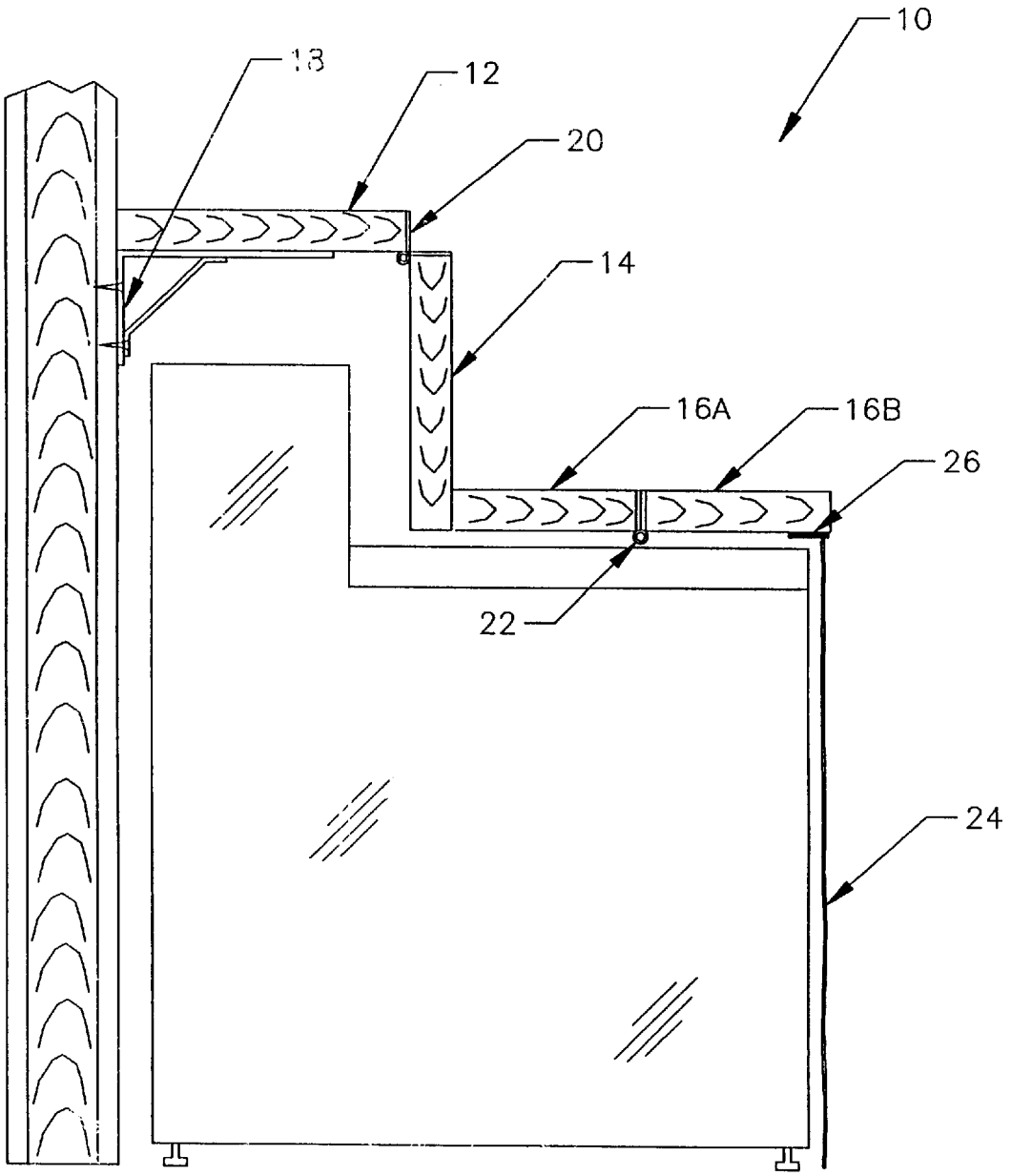
FIG. 3 is a section view of the countertop system of the present invention.

The countertop 16 is constructed of two sections 16*a* and 16*b* of equal length and width. The sections 16*a* and 16*b* of the countertop 16 are joined together by hinges 22. In use, the countertop sections 16*a* and 16*b* are disposed edge-to-edge to form a flat surface as shown in FIGS. 1 and 3. When the countertop 16 is not in use, the countertop section 16*a* and 16*b* can be folded one on top of the other and stacked on the top shelf 12 as shown in FIG. 2.

In a preferred embodiment of the invention, a skirt 24 is detachably secured to a forward edge of the countertop 16 and extends downwardly from the countertop 16 to the floor. To secure the skirt 24 to the countertop 16, a interlocking strip fastener, such as that sold under the brand name VELCRO is used. One fastening strip is secured underneath the forward edge of the countertop 16 while the opposing fastening strip is secured to the upper edge of the skirt 24. The skirt 24 can be detached by simply pulling downwardly on the skirt 24. The skirt 24 can then be folded and stored as shown in FIG. 2.

In the disclosed embodiment, the countertop 16 forms a separate piece from the top shelf 12 and drop panel 14. If desired, the countertop 16 can be attached to the lower edge of the drop panel 14 so that the entire assembly folds accordion style. Attaching the countertop 16 to the drop panel 14 would require additional hardware which would increase the cost of the countertop system. Further, such a system would be slightly more difficult to manipulate into and out of position.

Based on the foregoing, it is apparent that the countertop system of the present invention provides a relatively easy and convenient method for concealing an appliance which is located within the living area of a home. The countertop system 10 also makes it possible to use space allocated for appliances as a work area or service area. For example, the countertop system 10 could be used as an additional countertop or food service area when entertaining guests in one's home. The countertop system 10 is inexpensive to produce and thus provides a low-cost alternative to other types of closures.

What is claimed is:

1. A shelving system adapted to conceal an appliance in a deployed position and to fold into a storage position, said shelving system comprising:

a) a generally horizontal shelf supported above the appliance;

b) a drop panel pivotally connected to said horizontal shelf, said drop panel adapted to extend downwardly from the shelf in said deployed position and to fold against said horizontal shelf in said storage position;

c) a countertop having first and second pivotally connected countertop sections movable between a generally flat, unfolded configuration and a folded configuration;

d) wherein in said deployed position, said countertop is adapted to rest on an upper surface of said appliance in a generally flat, unfolded configuration and extend forwardly from the lower edge of said drop panel so as to substantially cover the upper surface of said appliance; and e) wherein in said storage position, said countertop is adapted to stack on top of said shelf for storage in a folded configuration.

2. The shelving system of claim 1 wherein a front edge of the countertop extends beyond a front edge of the appliance.

3. The shelving system of claim 2 further including a skirt extending downwardly from the front edge of the countertop in front of said appliance.

4. The shelving system of claim 3 further including means for detachably securing the skirt to the front edge of the countertop.

5. The shelving system of claim 4 wherein the securing means comprises first and second interlocking strips disposed respectively along the front edge of the countertop and an upper edge of the skirt.

6. The shelving system of claim 1 wherein the drop panel is pivotally attached to the shelf such that the drop panel is capable of folding against the shelf in a storage configuration.

7. The shelving system of claim 1 wherein the countertop is stackable on the shelf when the countertop is in its folded storage configuration.

8. A shelving system for concealing an appliance in a deployed position and to fold into a storage position, said shelving system comprising:

a) a generally horizontal shelf;

b) a shelf support for supporting the shelf above the appliance;

c) a drop panel extending downwardly in a substantially vertical plane from the shelf in said deployed position, said drop panel being pivotally connected to a forward edge of the shelf so as to be movable to said storage position in which the drop panel is folded against the shelf;

d) a countertop including first and second countertop sections which are pivotally connected such that the first and second sections are moveable between a generally flat unfolded configuration and a folded configuration, wherein in said deployed position said countertop is adapted to rest on an upper surface of said appliance in said generally flat, unfolded configuration and extend forwardly from the lower edge of said drop panel so as to substantially cover the upper surface of said appliance, and wherein in said storage position said countertop is adapted to stack on top of said shelf for storage in a folded configuration; and e) a skirt attached to the countertop and extending downwardly from the countertop.

9. The shelving system of claim 8 further including means for detachably securing the skirt to a forward edge of the countertop.

10. The shelving system of claim 9 wherein the securing means comprises first and second interlocking strips disposed respectively along the forward edge of the countertop and an upper edge of the skirt.

11. A combination shelving system and appliance comprising:

a) an appliance having an upper surface;

b) a generally horizontal shelf mounted above the appliance so as to from a first support surface;

c) a drop panel extending downwardly from a forward edge of the shelf;

d) a countertop having first and second pivotally connected countertop sections movable between a generally flat use configuration and a folded storage configuration; and e) wherein in said use configuration said countertop is adapted to rest on an upper surface of said appliance and extend forwardly from a lower edge of said drop panel; and f) wherein in said storage configuration, said countertop is adapted to stack on top of said shelf.

12. The shelving system of claim 11 wherein a front edge of the countertop extends beyond a front edge of the appliance.

13. The shelving system of claim 12 further including a skirt extending downwardly from the front edge of the countertop in front of said appliance.

14. The shelving system of claim 13 further including means for detachably securing the skirt to the front edge of the countertop.

15. The shelving system of claim 14 wherein the securing means comprises first and second interlocking strips disposed respectively along the front edge of the countertop and an upper edge of the skirt.

16. A method for simultaneously concealing an appliance and providing foldable shelving comprising:

a) mounting a first horizontal support surface above the appliance;

b) pivotally attaching a drop panel to said first horizontal support surface;

c) positioning said drop panel in a deployed position when said foldable shelving system is deployed so that said drop panel extends generally downwardly from said first horizontal support surface towards an upper surface of said appliance;

d) providing a second horizontal support surface having first and second foldable sections movable between a generally flat, unfolded and a folded;

e) supporting said second horizontal support surface on an upper surface of said appliance in said generally flat unfolded configuration so that said second horizontal support surface forwardly from a lower edge of said drop panel when said foldable shelving is deployed;

f) positioning said drop panel in a storage position when said foldable shelving is stored so that said drop panel is folded against said first horizontal support surface; and g) supporting said second horizontal support surface on top of said first horizontal support surface in a folded configuration when said foldable shelving is stored.

* * * * *